US007235157B2

(12) United States Patent
Mäenpää et al.

(10) Patent No.: US 7,235,157 B2
(45) Date of Patent: Jun. 26, 2007

(54) METHOD FOR CONTROLLING ONE OR MORE SURFACE QUALITY VARIABLES OF A FIBER WEB IN A SHOE CALENDER

(75) Inventors: Tapio Mäenpää, Helsinki (FI); Kalle Hasu, Järvenpää (FI); Matti Lares, Helsinki (FI); Pekka Koivukunnas, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 234 days.

(21) Appl. No.: 10/362,301

(22) PCT Filed: Aug. 23, 2001

(86) PCT No.: PCT/FI01/00742

§ 371 (c)(1),
(2), (4) Date: Jul. 1, 2003

(87) PCT Pub. No.: WO02/16694

PCT Pub. Date: Feb. 28, 2002

(65) Prior Publication Data

US 2004/0045454 A1 Mar. 11, 2004

(30) Foreign Application Priority Data

Aug. 24, 2000 (FI) ..... 20001872

(51) Int. Cl.
*D21F 11/00* (2006.01)

(52) U.S. Cl. ..... 162/198; 162/205; 162/358.3; 100/168; 100/153; 100/93 RP

(58) Field of Classification Search ..... 162/198, 162/358.3, 205; 100/168, 153, 93 RP
See application file for complete search history.

(56) References Cited

U.S. PATENT DOCUMENTS

| | | | |
|---|---|---|---|
| 4,370,923 | A | 2/1983 | Schmidt |
| 5,582,689 | A | 12/1996 | Van Haag et al. |

FOREIGN PATENT DOCUMENTS

| | | |
|---|---|---|
| EP | 0896088 | 8/1999 |
| FI | 76872 | 8/1988 |
| WO | 9966125 | 12/1999 |

*Primary Examiner*—Mark Halpern
(74) *Attorney, Agent, or Firm*—Ware, Fressola, Van der Sluys & Adolphson LLP

(57) ABSTRACT

The invention relates to a method for controlling a surface quality variable (300) in one or more fiber webs (3) in a shoe calender (1) comprising one or more calender nips. In each calender nip of the shoe calender, the overall loading pressure of the shoe element (8) and the loading pressure difference between the leading edge (8') and the trailing edge (8") of the shoe element are controlled so as to achieve minimum difference between the determined values (300") for the surface quality variables of the fiber web and the set values (300') for the same quality variables after the shoe calender.

18 Claims, 3 Drawing Sheets

METHOD FOR CONTROLLING ONE OR MORE SURFACE QUALITY VARIABLES OF A FIBER WEB IN A SHOE CALENDER

CROSS REFERENCE TO RELATED APPLICATIONS

This application is for entry into the U.S. national phase under §371 for International Application No. PCT/FI01/00742 having an international filing date of Aug. 23, 2001, and from which priority is claimed under all applicable sections of Title 35 of the United States Code including, but not limited to, Sections 120, 363 and 365(c), and which in turn claims priority under 35 USC §119 to Finnish Patent Application No. F120001872 filed on Aug. 24, 2000.

TECHNICAL FIELD

The invention relates principally to a method for controlling one or more surface quality variables of a fiber web in a shoe calender.

BACKGROUND OF THE INVENTION

A shoe calender is formed of one or more calendering nips, where calendering is performed. Each calendering nip, in turn, comprises a heated thermo roll and an endless belt, which is located opposite this and under which a shoe element pressurized by loading means is provided at the roll nip. The loading means comprises two rows of hydraulic cylinders, one of the rows of hydraulic cylinders being located at the trailing edge of the shoe element and the other one at the leading edge of the shoe element. The endless belt rotates about the stationary plate frame of the shoe roll located opposite the thermo roll. The fiber web runs between one or more roll nips in the shoe calender, its surface being thus calendered with the desired smoothness, thickness, opacity and glaze (quality variables of the fiber web). The quality variable values, in turn, depend on the actions to which the fiber web is subjected in the calendering nip, i.e. the nip process. The nip process is affected by the roll nip condition, i.e. the total weight, the weight distribution and the temperature of the roll nip, and also the humidity and temperature of the fiber web when running through the nip, and finally the calendering period, i.e. the residence time of the fiber web in the roll nip.

The factors acting on the nip process are usually controlled by the following control variables:

- the linear pressure acting on the roll nip condition is formed by the mutual pressure of the shoe roll and the thermo roll against each other, this pressure being adjustable for instance by varying the weight of the shoe roll and the thermo roll. The linear pressure in the shoe calender also depends on the overall loading pressure of each shoe element.
- the humidity and temperature of the fiber web can be controlled by the dewatering degree of the fiber web and by blowing steam onto the fiber web surface before the roll nip.
- the roll nip temperature is primarily controlled by the thermo roll temperature, which has been generated either by internal or external heating of the roll, by means of a separately controlled actuator, induction heater, heat blower or the like.
- the calendering period depends on the fiber web rate and the roll nip length, the former being used as an active variable for controlling the nip process.

Besides the active control variables mentioned above, the state of the calendering nip in shoe calendering depends on the overall loading pressure of the shoe element and on the weight distribution between the leading edge and the trailing edge of the shoe element. In this context, the leading edge of the shoe element stands for the edge that is parallel with the longitudinal axis of the shoe roll and that the fiber web contacts as it reaches the roll nip, whereas the trailing edge stands for the edge of the shoe element that is parallel to the longitudinal axis of the shoe roll and that the fiber web leaves as it is detached from the roll nip.

The inclination of the shoe element is varied by means of the loading pressure difference between the rows of hydraulic cylinders provided under the leading and trailing edge of the shoe element, so that the load exerted by the hydraulic cylinders on the trailing edge of the shoe element is greater than the load exerted on the leading edge. The loading pressure difference between the trailing edge and the leading edge of the shoe elements is called "tilt", in other words, the load exerted on the trailing edge of the shoe element exceeds the load on the leading edge by the tilt. In shoe calenders, the tilt and the total pressure of the shoe element act on the state of the roll nip and thus affect the calendering result.

SUMMARY OF THE INVENTION

The method of the invention was based on the effort to achieve high-precision overall control of the fiber web quality variables for each grade on all the premises of the paper mill, and when the fiber web enters the production premises at start-up of the shoe calender operation. In this context, quality variables for each grade means the quality variables obtained by calendering for different board and paper grades, such as smoothness, opacity, thickness and glaze.

The chief purpose of the method of the invention is to provide a new pervasive method for adjusting the control variables acting on the calendering result of the shoe calender, i.e. the fiber web quality variables, the method covering more control variables than conventional methods for controlling shoe calenders.

The purpose of the invention is to provide a new overall control method under normal production conditions, where the fiber web rate does not vary substantially or the changes in the fiber web rate do not affect the quality variables of the fiber web.

Another purpose of the invention is to provide a new overall control method when the fiber web rate changes substantially, typically in situations where the web enters the production premises or passes from one production department to another.

The method of the invention comprises the control of one or more surface quality variables of the fiber web in a shoe calender comprising one or more calender nips.

In each roll nip, the overall loading pressure of the shoe element is controlled, and so is the loading pressure difference between the leading edge and the trailing edge of the shoe element, so as to achieve a minimum difference between the set values of the quality variables and the values measured for the surface quality variables of the fiber web after the shoe calender. The method of the invention comprises the control of the surface quality variables of the fiber web in a shoe calender including one or more calender nips.

In addition, the method comprises the control of quality variables by means of control variables known per se that act on the nip process, such as the amount of steam blown onto the fiber web surface, the thermo roll temperature, the linear pressure of the calender nip, the fiber web rate and/or the fiber web humidity.

Under normal production conditions, the quality variables of the fiber web are usually controlled by a feed-back control method by

- determining one or more surface quality variables of the fiber web after one or more roll nips in the shoe calender,
- comparing the determined surface quality variables of the fiber web with the set values for these quality variables,
- determining, by means of a computing program and on the basis of the difference between the set values for the quality variables and the determined surface quality variables of the fiber web, the optimal overall loading pressure for each shoe element of the calender nip and the optimal pressure difference between the leading edge and the trailing edge of the shoe element.
- controlling the loading pressure difference between the leading edge and trailing edge of each shoe element and the overall loading pressure of the shoe element to an optimal value by means of the loading means.

The difference between the set value and the measured value of one or more quality variables allows the control of one or more other control variables acting on the nip process.

In the case of a shoe calender with several nips, the quality variables of the fiber web to be calendered are optimized by optimizing the control variables separately in each calender nip of the shoe calender.

In an ordinary production situation, the control method described above yields the chief advantage of allowing control of the nip process in the shoe calender and thus also of the fiber web quality variables (such as fiber web smoothness, thickness, opacity and glaze) with markedly higher precision than before, by taking account of the shoe element tilt and the overall loading pressure as an additional active control variable in the nip process. Control of the nip process with higher precision results in a lower fiber web waste percentage.

Should the fiber web rate V change substantially from a first rate V1 to a second rate V2, while the first fiber web rate equals the set value for the first overall loading pressure of the shoe element in one or more calender nips of the shoe calender and the loading pressure difference between the leading edge and the trailing edge of the shoe element, the control is performed by

- with the fiber web rate changing to the rate V2, a new set value for the optimal overall loading pressure of one or more shoe elements in the shoe calender and for the loading pressure difference between the leading and the trailing edge of the shoe element is determined by means of a computing program, the new set value equaling the second fiber web rate V2,
- changing the pressure difference between the leading and trailing edge of one or more shoe elements and the overall loading difference of the shoe element, so that they equal the new set values for the loading pressure difference between the leading and trailing edge and the overall loading pressure with the aid of the loading means provided under each shoe element.

In one embodiment, the pressure difference between the leading edge and the trailing edge of the shoe element and the overall loading pressure of the shoe element are changed so as to equal the new set values for the loading pressure difference between the leading edge and the trailing edge of the shoe element by staggering during a period AT over consecutive set values. Predicting multi-variable algorithms are preferably used for the staggered change of the set values, and a so-called MPC control algorithm is especially preferably used.

The staggered, predicting control methods mentioned last have the advantage of allowing faster and more efficient control than before of the quality variables of the fiber web to be calendered in a shoe calender when normal production is being started (e.g. during the start-up of a paper machine/calendering unit) and/or when the fiber web rate changes substantially. The rapidity of predicting control methods is due both to the nature of the control algorithms and to the loading means loading the shoe element being formed by hydraulic cylinders, which react rapidly to variations in the hydraulic pressure. By taking account of the overall loading pressure of the shoe element and the tilt as an additional control variable, transitional conditions can be controlled also in situations where it used to be impossible.

Among the benefits of staggered control with predicting MPC control algorithm it can be especially mentioned that the control algorithm compensates for the cross effects between the control variables, allows for the restrictions of the control variables and compensates for the process lag generated between the change of the control variables and the change of the process quality variables.

Among the additional benefits gained with the method of the invention, we note that using the tilt and the total pressure of the shoe element as an active control variable is a straightforward, inexpensive and fast way of controlling the nip process. Changing the thermo roll temperature, the fiber web rate, the amount of steam supplied to the fiber web surface and similar control variables generally used in shoe calendering is notably slower, more laborious and expensive than the control of the tilt and the total pressure of the shoe element, which frequently achieve the same end result as the joint control of several control variables.

BRIEF DESCRIPTION OF THE DRAWINGS

The invention is described in greater detail below with reference to the accompanying figures.

DETAILED DESCRIPTION OF THE INVENTION

A short explanation of each figure is given below.

Figure 1:
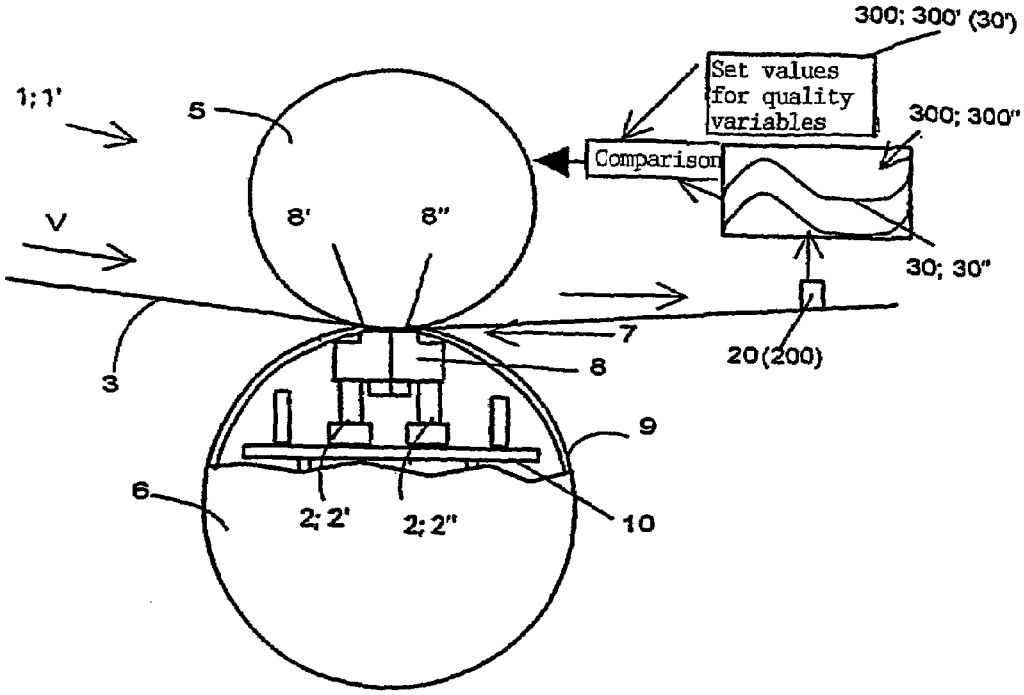
FIG. 1 is a schematic view of the calender nip viewed from the end of the roll nip in partial cross-section.

FIG. 1 is a schematic view of a shoe calender 1 comprising one calender nip 1'. The main parts of the calender nip, in turn, consist of the heated thermo roll 5 and the shoe roll 6 opposite to this. An endless belt 9 rotates on the stationary frame 10 of the shoe roll. The belt rotating on the shoe roll frame and the thermo roll are spaced by the roll nip 7, where the surface of the fiber web 3 is calendered. The fiber web runs from the left to the right in the figure, in the direction of the arrows, at a rate V. A nip pressure is generated in the roll nip by means of the loading means 2, which is located below the shoe element 8 and is formed of rows of hydraulic cylinders 2' and 2" which pressurize the leading edge 8' and the trailing edge 8" of the shoe element. One or more quality variables 300 of the fiber web are determined with a measuring sensor 20 or several measuring sensors 200 after the nip. A control signal is generated from the difference between one or more determined quality variables 300" and the set values 300' for these quality variables. If one single measuring sensor is used for the determination, one single quality variable is determined, with a control signal generated from the difference between its set value 30' and the determined value 30".

Figure 2:
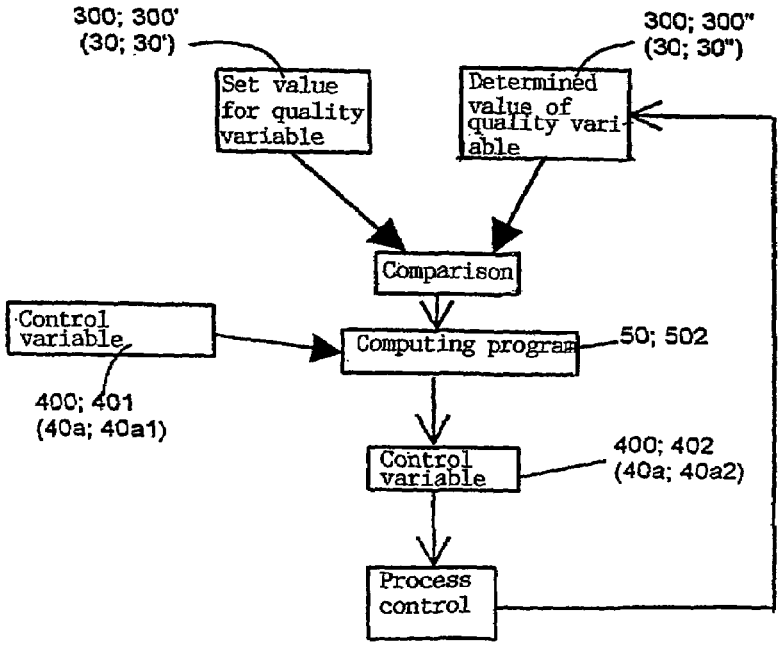
FIG. 2 is a schematic illustration of the principle of the feed-back control of quality variables used in the control method of the invention.

FIG. 2 shows a typical feed-back control strategy for one or more quality variables. The values 300" (30') determined for one or more quality variables 300 (or a single quality variable 30) are compared with the set values 300' (or 30) for the same quality variables. Based on the comparison, changes are made in one or more control variables 400 by means of the computing program 50. The control variables act on the nip process and consequently on the quality variables/quality variable 300 (30). The control variable (s) imply feed forward, i.e. predicted set values for these particular control variables in predicting control methods, which are calculated on the difference between the predicted set values and the reference set values of the quality variables.

Figure 3:
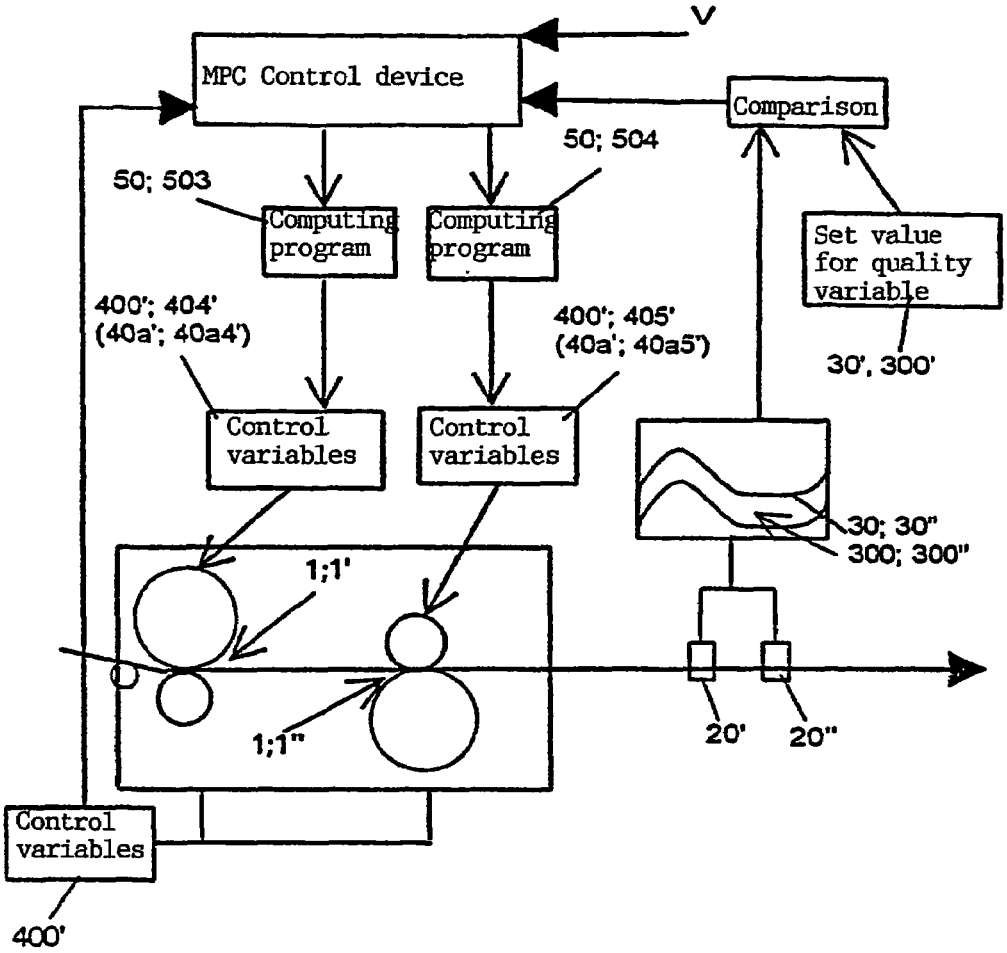
FIG. 3 is a schematic view of a so-called MPC control (feed-forward control method).

FIG. 3 is a schematic view of the operation of a multivariable control device (MPC control device). The MPC control device is informed of the difference between the determined value 300" (30') and the set value 300' (30) of one or more quality variables, the current values of the set values 400' for the control variables acting on the nip process, and the fiber web rate V, and subsequently sets the set values 400' of one or more control variables by means of the computing program 50. The figures in brackets refer to the situation where an individual quality variable 30 is determined and compared to the set value for this particular quality variable.

Figure 4:
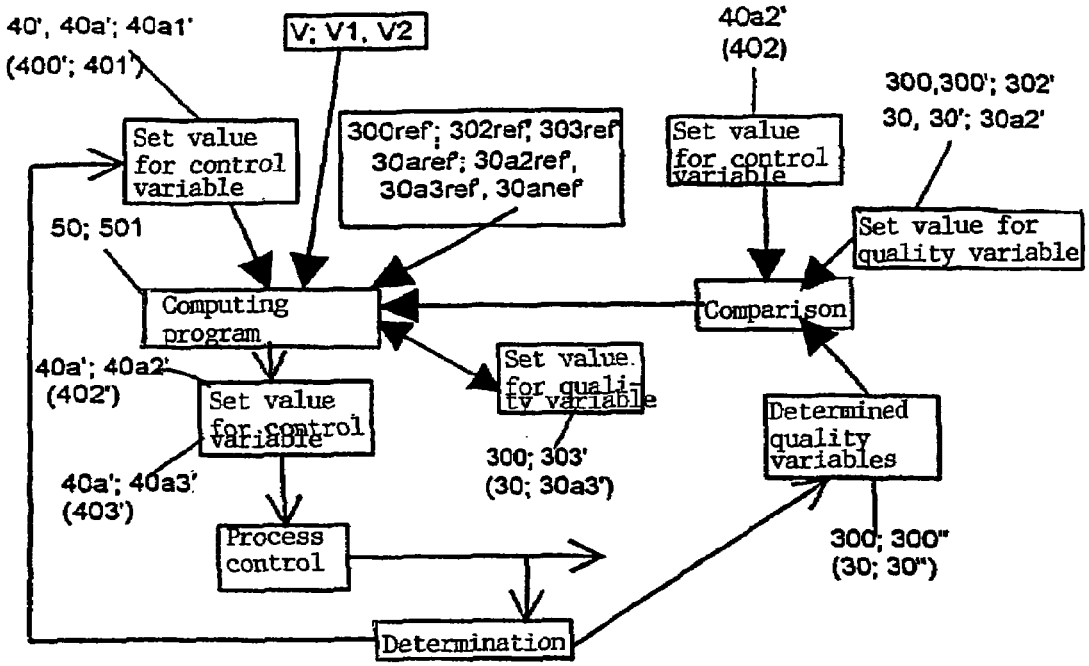
FIG. 4 is a schematic view of the control method of the invention as a so-called feed-forward control with the use of an MPC control algorithm, as the fiber web rate changes substantially.

FIG. 4 is a schematic illustration of a control method implementing a predicting MPC algorithm as the rate V of the fiber web 3 passes substantially from a first rate V1 to a second rate V2. In the control method, the set values 40*a*' for the tilt of the shoe element and the overall loading pressure are changed from the value 40*a*1' to 40*a*2' and further to 40*a*3' by means of the computing program 50; 501. The set values 400' for the other control variables can also be altered from 401' to 402' and further to 403'. The method comprises periodical determination of one or more quality variables 300, the determined values 300" of which are compared with the current predicted set values 300' (302' in this case) for the same quality variables. New predicted set values 300' (303' in this case) are calculated on the difference between the current predicted set values 400' (402' here) and the predicted and determined values of these quality variables. The predicted set values for the quality variables are compared with the reference set values 300*ref* (303*ref* here) for the same quality variables, and on the difference, new predicted set values 40*a*' (40*a*3' here) are calculated for the tilt and the overall loading pressure, and possibly also set values 400' (403' here) for other control variables. Instead of a plurality of quality variables 300, a single quality variable 30 can also be determined, with a control signal generated from the difference between its determined value 30" and the current predicted set value 30', the control signal being used to change the predicted set value for the quality variable and the control variables.

Figure 5:
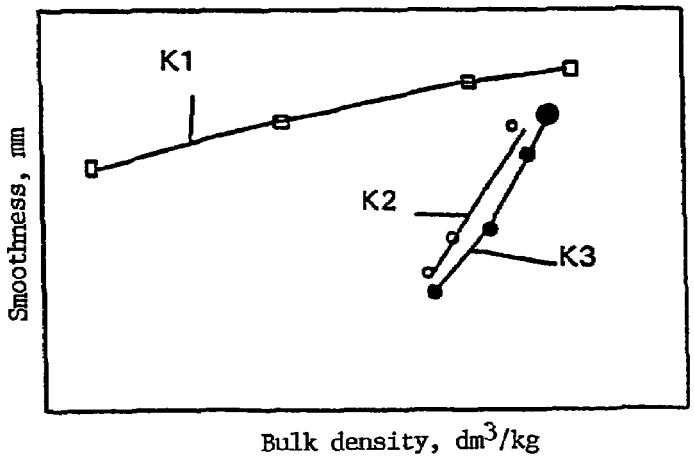
FIG. 5 shows a bulk density smoothness chart of the fiber web with three different shoe element tilts.

FIG. 5 shows the smoothness of a soft paper grade as a function of its bulk density, with the overall loading pressure of the shoe element being unaltered, but with the tilt at three different values K1 (0), K2 (1.05) and K3 (1.30).

The method of the invention uses either a single or multivariable control device. Regardless of the control device quality, the control strategy mainly follows the so-called feed-back principle shown in FIG. 2 regarding the quality variables; the current determined values 300; 300", (30; 30") of one or more quality variables of the fiber web are compared with the corresponding set values 300; 300' (30; 30') of the fiber web quality variables. Using the comparison, a control signal is generated on the difference between the set value for the quality variables and the determined value, and on the basis of the control signal, the computing program 50 is used to make changes in the selected control variables 400 (40) with the control method adopted in each case. In predicting feed-forward control methods, changes are not made in the control variables, but instead in the set values 400' (40) for the control variables (predicted set values).

In feed-forward control methods, the set values for quality variables stand for predicted set values for quality variables which have been calculated from the process control history, that is the previous control variable values and the determined quality variables and the previous predicted set values for quality variables, the predicted quality variable set values being the same as or different from the current desired set values for the quality variables (reference set values). The figures in brackets refer to the situation in which, instead of a plurality of quality variables 300, a single quality variable is determined, whose determined value is 30" and set value is 30'. Accordingly, the changes can be made also in a single set value 40 or in the set value 40' for a single control variable in feed-back control methods. Thus, for instance, the starting value 40*a*1 for the shoe element tilt and the overall loading pressure is adjusted to the value 40*a*2 with the computing program 503 on the basis of the control signals obtained with the computing program 502 from the difference between the set value 30' and the determined value 30" of the quality variable. Similarly, the values of the other control variables 400 can also be changed from 401 to 402. The computing program is a table, a curve, a computing model or the like. If the fiber web rate V changes substantially, as in the control strategy shown in FIG. 4, which operates completely on the feed-forward control principle, i.e. using predicting control, the feed-back control method described above will be implemented as follows: a signal from the difference between the determined value 300" (30") of one or more quality variables and the current predicted set value 300' (30) is periodically transmitted to the computing program 502, which, on the basis of this control signal, first corrects the predicted set values for the quality variable(s), and subsequently the predicted set values 400' (40) of the control variable (s).

When the control strategy comprises a unit control device, specific control variables 400 acting on the nip process are selected, and using these, separately selected quality variables 300 are controlled by means of a specific computing program 50, i.e. a calculation function, formula, table or curve. In the method of the invention, one of the control variables 40 is consistently the shoe element tilt and the total pressure 40*a*. Thus, when the unit control strategy is used, the current determined value 30" of a given quality variable of the fiber web 3, which has been determined for instance after the calender nip as in FIG. 1 is compared with the set value 30' for this particular quality variable, and a control signal is generated from the difference between the determined value and the set value, and then, on the basis of the control signal, the computing program calculates a new tilt and overall pressure, resulting in the set value 30' for the quality variable.

In the control strategies followed in the method, the effect of the control variables 400 on the selected quality variables 300 are known via the computing program 50, i.e. as a response model, function, table or curve. If a multivariable control method is used, the control variables 400 are then given maximum and minimum values, within the range of which each single control variable 40 can be changed. Thus, for instance, when the effect of the tilt and the total pressure 40*a* of a shoe element used as a control variable on the selected quality variables 300 is known, it is possible to set minimum and maximum limits, within which the tilt and the total pressure of the shoe element can vary. In multivariable control, the simultaneous effect of several control variables 400 on the nip process is considered. One such control strategy is represented by the MPC control device, i.e. predicting multivariable control device shown in FIGS. 3 and 4. The method uses a so-called feed-forward control method, in which a response model is used to search the optimal set values 400' for all the control variables used (e.g. thermo roll temperature, shoe element tilt and total loading pressure, amount of steam supplied to the fiber web), which achieve the desired nip process. In order to calculate the set values, one has to know the responses of the selected control variables to one or more quality variables 300, and in addition, the mutual cross-effects of the control variables have to be determined (response model).

After this, the control of the nip process can be performed optimally on all the control variables within the limits of the minimum and maximum values determined for these. The control variable set values corresponding to the quality variables 300 are obtained with the computing program 50.

FIG. 3 shows a multivariable control device using the MPC control algorithm, in which one control variable consists of the shoe element tilt and the overall loading pressure 40*a*. The control is performed on a shoe calender comprising two calender nips 1; 1', 1". In the method, the set values 400' chosen for the control variables are changed on the basis of the control signal obtained from the difference between the determined values 300" (or one single determined value 30) of the quality variables and the set values 300' (or one quality variable set value 30). The calculation of the set values for each control variable takes account also of the other control variables acting on the nip process, and the mutual cross-effects of the control variables are determined. In addition, the calculation of the set values for the control variables may take account of the effect of the fiber web rate V. The MPC control device of the figure adjusts simultaneously the set values 400' of several control variables acting on the nip process, such as the linear load on the roll nips, the thermo roll temperature, the amount of steam supplied to the fiber web surface and the set values 40*a*' for the shoe element tilt and the overall loading pressure. A multivariable control device obtains the determined values 300" (30') for one 30 or more 300 quality variables (e.g. paper thickness, glaze, smoothness) at a determination point 20'. 20" after the two calender nips. The determined values 300" (30') of the quality variables are compared to the current predicted set values 300' (30) of the same quality variables, and a control signal is generated from the difference between the determined value and the set value of each quality variable, and the control signal is transmitted to the MPC control device. In addition, the MPC control device receives information about the current rate V of the fiber web and the selected current set values 400' for the process control variables acting on the nip process, including information about the current shoe element tilt and the overall loading pressure 40*a*' in the calender nips 1; 1' and 1; 1". Then the computing program 50; 503 calculate new set values 404' and 405' for the selected control variables, such as the shoe element tilt and the overall loading pressure 40*a*', the linear load on the roll nips, the thermo roll temperature, the amount of steam supplied to the fiber web surface and the temperature. New set values can also be calculated for instance merely for the shoe element tilt or the overall loading pressure 40*a*' (40*a*4' and 40*a*S). The set values are calculated separately for each calender nip 1; 1' and 1; 1" considering the cross-effects of the control variables on the quality variable (s). An MPC control device can be used both in a normal production situation and when the fiber web rate changes substantially, typically in the start-up step of the shoe calender, during which the output changes.

As the web rate changes, the control of the shoe element tilt and the overall load pressure can be performed either as multivariable control or single-variable control.

However, since it is important, at a changed web rate, to use rapidly controllable control variables, such as the shoe element tilt and the total pressure alone, a unit control strategy is usually adopted, in which the pressure is adjusted on the basis of the reference values for the quality variables by means of the hydraulic cylinders 2', 2" determining the loading pressure of the shoe element, following a suitable calculation model, without taking account of the effect of other control variables. Multivariable control is usable when the fiber web rate changes relatively slowly, and then the control strategy adequately allows for the effect of the other control variables on the selected quality variables as well.

FIG. 4 is a still closer study of the predicting multivariable control strategy of the invention implemented with an MPC control device, when the fiber web rate V changes substantially, from V1 to V2, for instance in the start-up step of the shoe calender 1. As shown in FIG. 1, the shoe calender has one roll nip 7, which is formed between the thermoroll 5 and the shoe roll 6 opposite this.

The set value 40'; 40*a*1' for the tilt of the shoe element 8 and the total pressure is now changed by means of the computing program 50; 501 so as to better meet the requirements imposed by the new web rate V2 on the control variable 40*a*'. First, the set value for the control variable, i.e. the shoe element tilt 40*a*', is changed so that the predicted set value 30'; 30*a*' for the selected quality variable approaches the first point of adjustment, equaling the reference set value 30*aref'*; 30*a*2*ref* of the quality variable, which is different from the final reference value 30*anref* of this quality variable. The control variable calculation uses information about the differences between the reference values 30*aref* and 30*anref* and the values of said control variable, quality variable and any disturbance variable. A new predicted set value 40*a*'; 40*a*2' is obtained for the shoe element tilt and the total pressure with the cost function of the selected calculation method, using computing program 50; 501.

This predicted set value 40*a*2' for the control variable is equalled by the predicted set value 30*a*2' for the quality variable. If a new reliable determined value 30" has been obtained for the quality variable from the traversing measuring sensor located after the calender nip 7, the determined quality variable value 30" is compared to the predicted set value 30*a*2' for the same quality variable. The computing program gives the difference between these values, and the current value 40*a*2' for the control variable serves to get a new predicted set value 30*a*3' for the quality variable. The predicted set value 30*a*3' of the quality variable is then compared with the current reference set value 30*a*3*ref'*, which should apply to the quality variable at the moment of determination, and on the basis of the difference between these values, a new predicted set value 40*a*3' is calculated for the control variable. However, should the predicted set value 30*a*3' for the quality variable be the same as the reference set value 30*a*3*ref*, no changes are made in the current set value 40*a*2' of the control variable. Should the reference set value 30*a*3*ref* be the same as the desired set value 30*anref* for the quality variables, the control variable 40*a'* is no longer changed. Otherwise, the procedure for determining quality variables described above is repeated. The set value 40*a*1' for the shoe element tilt and the total pressure is set to new set values 40*a*2' and 40*a*3' etc. by means of the loading means 2 of the shoe element 8, consisting of two rows of hydraulic cylinders.

When the fiber web rate has passed substantially from V1 to V2 in the simplified control algorithm described above, the shoe element tilt and the total pressure are changed accordingly over staggered periods. However, a prerequisite for this is that reference set values and predicted set values are available at each moment for the quality variables and the control variables on the basis of any model, calculation function or table.

In the control algorithm described above, the shoe element tilt and the total pressure and possibly other control variables are changed repeatedly at the end of a given period of time. This period is determined by the actuator dynamics, such as the speed of the hydraulic cylinders and the process delays. Thus, for instance, the set values 40*a'* for the shoe element tilt and the total pressure are changed during the period AT, from the set value 40*a*1' corresponding to the first fiber web rate to the set value 40*an'* corresponding to the second fiber web rate over the predicted set values 40*a*2'; 40*a*3', etc. One or more quality variables 300 are measured at suitable intervals, and a control signal is generated from the difference between the determined quality variables 300" and the current predicted set values 300' for the quality variables and the predicted set values for the control variables, the control signal being used to adjust the first predicted set value 300' for the quality variable from the first value to the second value. By comparing the set value obtained for the second quality variable to the reference set value 300*ref* for the quality variable prevailing at the moment of determination, a new predicted set value is calculated on the difference for the control variable by means of a suitable computing program 50. The reference set values are either fixed or variable. When the reference set values are variable, their variation pattern, i.e. trajectory, must be known in advance.

Specifically in MPC control, new predicted set values for the control variables are calculated on the difference between the reference set value for the quality variable and the obtained predicted set value with the use of a calculation function based on the minimization of the quadratic cost function of the difference variable, the variations of the predicted set values for the control variable being as small as possible. The MPC algorithm takes account of the restrictions of the control variables with the aid of the weight functions of the different control variables of the cost function, and thus it is ensured that the shoe element tilt, for instance, does not reach too high values.

Instead of individual quality variables, it is possible to determine also a plurality of selected quality variables 300. It is equally possible to determine the current values 300" of several quality variables with several measuring sensors and to compare these values with the set values 300' of these quality variables. It is also possible to simultaneously change the set values 400' of several control variables 400 from 401' to 402' and further to 403', in a similar manner as for an individual control variable 40*a'*.

The method of the invention allows the smoothness of say, a given paper grade, to be adjusted merely by means of the shoe element tilt and/or by varying the overall loading pressure. In FIG. 5, the overall loading pressure of the shoe element has been kept constant, while its tilt has been changed. The figure shows that better smoothness values are reached for soft paper with the same bulk density by merely tilting the shoe element to a certain extent.

One embodiment of the invention alone has been described above, however, it is obvious for those skilled in the art that the invention can be carried out in many other ways within the scope of the inventive concept defined in the claims. Thus, the invention can be implemented in shoe calenders where the calender is aligned with the paper machine production, or provided as an off-line unit apart from the remaining paper machine production.

Only a process option has been described above, in which the quality variables of the fiber web are determined after the calender nips of the shoe calender. In some cases, however, it is possible to speed up the control algorithms by determining the quality variables also before the calender nips. This optional determination of the quality variables is applicable especially to shoe calenders comprising several calender nips and using a predicting control method.

The quality variable determination can be performed with a traversing measuring sensor, which measures the properties of the fiber web 3 in a given area of the fiber web, for instance as described in U.S. Pat. No. 5,943,906. However, in some cases, when it is desirable to speed up the measurements, for instance when the fiber web rate V changes rapidly, it may be preferable to use a point-like measuring sensor, which measures one or more quality variables of the fiber web at one point of the fiber web (point-like measuring method). Such a partial method of measuring a quality variable is less reliable, but considerably faster, than a measurement of a quality variable made with a traversing measuring sensor over a longer distance.

The control of the surface quality variables of a fiber web by means of an MPC predicting control algorithm has been described above. However, other appropriate predicting control algorithms are also applicable to the control of quality variables, the embodiment and cost function of these having been described in detail for instance in the publication Aiche Symposium, Vol 93–97, pp. 232–256, California 1996.

The invention claimed is:

1. A method for controlling at least one surface quality variable in a fiber web in a shoe calender having at least one calender nip, comprising the steps of:

(a) providing a shoe element in each calendar nip; and (b) controlling, in each calender nip of the shoe calender, overall loading pressure of the shoe element and loading pressure difference between a leading edge and a trailing edge of the shoe element to achieve minimum difference between each determined value for the at least one surface quality variable of the fiber web and each set value for the at least one surface quality variable after the shoe calender, the controlling step being conducted based on the effect of the loading pressure difference between the leading edge and the trailing edge of the shoe element on the at least one surface quality variable as known through a control algorithm chosen from the group consisting of a response model, a table and a curve, whereby, when web rate V is substantially changed from a first fiber web rate V1 to a second fiber web rate V2, controlling is carried out by changing mentioned set value for at least one surface quality variable in a staggered way over consecutive set values based on predicting control algorithm.

2. The method as defined in claim 1, further including the step of adjusting a control variable acting on roll nip condition whereby the control variable is chosen from the group consisting of the temperature of a roll nip, calendering period, the loading pressure in the at least one calender nip and humidity and temperature of the fiber web.

3. A method as defined in claim 2, wherein the predicting control algorithm changes the fiber web rate V substantially from the first fiber web rate V1 to the second fiber web rate V2, the first fiber web rate being equaled by a set value for the overall loading pressure of the shoe element in the shoe calendar and the set value for the loading pressure between the leading edge and the trailing edge of the shoe element, and second fiber web rate V2 being equaled by the desired set value for at least one surface quality variable, while the fiber web rate V is changed from the first fiber web rate V1 to the second fiber web rate V2, the set value of the pressure difference between the leading edge and the trailing edge of the shoe element and the set value of the overall loading pressure of the shoe element is changed with the aid of a computing program on the basis of the difference between set values and the determined values for the at least one surface quality variable so that the set value of at least one quality variable approach the desired set value for same quality variable.

4. The method as defined in claim 3, wherein calculating the set values of the control variables from the difference between set values and the determined values for the at least one surface quality variable is done on the basic of the response of the control variables to at least one quality variable and additionally on the basic of the mutual cross-effects of the control variables.

5. The method as defined in claim 3, wherein the pressure difference between the leading edge and the trailing edge of the shoe element and the overall loading pressure of the shoe element are changed over a period ΔT over set values equaling the set values of at least one quality variable by means of the loading means provided under the shoe element.

6. A method as defined in claim 1, wherein the predicting control algorithm changes the fiber web rate V substantially from the first fiber web rate V1 to the second fiber web rate V2, the first fiber web rate being equaled by a set value for the overall loading pressure of the shoe element in the shoe calendar and the set value for the loading pressure between the leading edge and the trailing edge of the shoe element, and second fiber web rate V2 being equaled by the desired set value for at least one surface quality variable, while the fiber web rate V is changed from the first fiber web rate V1 to the second fiber web rate V2, the set value of the pressure difference between the leading edge and the trailing edge of the shoe element and the set value of the overall loading pressure of the shoe element is changed with the aid of a computing program on the basis of the difference between set values and the determined values for the at least one surface quality variable so that the set value of at least one quality variable approach the desired set value for same quality variable.

7. The method as defined in claim 6, wherein the pressure difference between the leading edge and the trailing edge of the shoe element and the overall loading pressure of the shoe element are changed over a period ΔT over set values equaling the set values of at least one quality variable by means of the loading means provided under the shoe element.

8. The method as defined in claim 7, further comprising the step of adjusting the set values for other control variables in addition to controlling the set values for the loading pressure difference between the leading edge and the trailing edge of the shoe element and for the overall loading pressure of the shoe elements.

9. The method for controlling at least one surface quality variable for a fiber web as defined in claim 8, wherein the at least one surface quality variable for the fiber web is measured at suitable time intervals.

10. The method as defined in claim 9, wherein the surface properties of the fiber web are determined point-wise at one point of the fiber web surface or traversing over a given area of the fiber web surface.

11. The method as claimed in claim 9, wherein the at least one surface quality variable for the fiber web is measured completely.

12. The method as defined in claim 7, wherein the method further includes following steps:

calculating several reference values for at least one quality variable, which differ from desired set value at web rate V2 of the same at least one quality variable;

as the fiber web rate changes from the first fiber rate to the second fiber rate during a time period, determining at least one surface quality variable value on the fiber web surface at given intervals;

based on the set value of the loading pressure difference between the leading and the trailing edge of the shoe element and the overall pressure at the first fiber rate, calculating the first predicted set value for loading pressure difference between the leading and the trailing edge of the shoe element and the overall pressure so that first predicted set value for at least one surface quality variable is created;

comparing the determined, at least one quality variable value with the first predicted set value for at least one surface quality variable;

using a computing program to calculate a second predicted set value for each at least one quality variable, on the basis of the difference between the determined at least one quality value and the first predicted set value for each at least one surface quality variable, and on the basis of the first predicted set value, for the loading pressure difference between the leading and the trailing edge of the shoe element and the overall pressure;

comparing the second predicted set value for each at least one quality variable with the reference set value of each at least one quality variable; and using the computing program to calculate, based on the difference between the second predicted set value and the reference set value for at least one surface quality variable, a second predicted set value for the loading pressure difference between the leading and the trailing edge of the shoe element and the overall pressure.

13. The method as defined in claim 12, wherein, in addition to calculating the loading pressure difference between the leading and the trailing edge of the shoe element and the overall pressure, a second predicted set value for at least one other control variable is calculated on the basis of the first predicted set value for the at least one other control variable and the difference between the determined value and the first predicted set value for the at least one other quality variable.

14. The method for controlling at least one surface quality variable for a fiber web as defined in claim 7, wherein the at least one surface quality variable for the fiber web is measured at suitable time intervals.

15. The method as claimed in claim 14, wherein the at least one surface quality variable for the fiber web is measured completely.

16. The method as defined in claim 6, further comprising the step of adjusting the set values for other control variables in addition to controlling the set values for the loading pressure difference between the leading edge and the trailing edge of the shoe element and for the overall loading pressure of the shoe elements.

17. The method as defined in claim 6, wherein calculating the set values of the control variables from the difference between set values and the determined values for the at least one surface quality variable is done on the basic of the response of the control variables to at least one quality variable and additionally on the basic of the mutual cross-effects of the control variables.

18. The method as defined in claim 17, further comprising the step of adjusting the set values for other control variables in addition to controlling the set values for the loading pressure difference between the leading edge and the trailing edge of the shoe element and for the overall loading pressure of the shoe elements.

* * * * *